US009443500B2

(12) United States Patent
Hoerbelt

(10) Patent No.: US 9,443,500 B2
(45) Date of Patent: Sep. 13, 2016

(54) PEDAL FOR MODULATING AN ELECTRONIC SIGNAL

(71) Applicant: Curtis Hoerbelt, Lancaster, NY (US)

(72) Inventor: Curtis Hoerbelt, Lancaster, NY (US)

( * ) Notice: Subject to any disclaimer, the term of this patent is extended or adjusted under 35 U.S.C. 154(b) by 0 days.

(21) Appl. No.: 14/554,680

(22) Filed: Nov. 26, 2014

(65) Prior Publication Data

US 2016/0148607 A1 May 26, 2016

(51) Int. Cl.
*G10H 1/32* (2006.01)
*G10H 1/00* (2006.01)

(52) U.S. Cl.
CPC ..... *G10H 1/0091* (2013.01); *G10H 2220/275* (2013.01); *G10H 2220/561* (2013.01)

(58) Field of Classification Search
CPC ..... G01L 1/16; G01L 5/225; G10H 1/32; G10H 1/02; G10H 2220/561; G10H 2210/155
See application file for complete search history.

(56) References Cited

U.S. PATENT DOCUMENTS

| | | | | |
|---|---|---|---|---|
| 3,744,341 | A | 7/1973 | Martin et al. | |
| 4,044,642 | A | 8/1977 | Pearlman et al. | |
| 4,630,520 | A * | 12/1986 | Bonanno | G10H 1/342 84/647 |
| 4,702,141 | A * | 10/1987 | Bonanno | G10H 1/342 84/626 |
| 5,003,859 | A | 4/1991 | Monte et al. | |
| 5,115,705 | A | 5/1992 | Monte et al. | |
| 5,300,729 | A | 4/1994 | Tokunaga et al. | |
| 5,322,967 | A | 6/1994 | Matsuda | |
| 5,741,993 | A | 4/1998 | Kushimiya | |
| 5,850,051 | A | 12/1998 | Machover et al. | |
| 6,078,006 | A * | 6/2000 | Raisanen | G10H 3/185 84/723 |
| 6,376,759 | B1 | 4/2002 | Suzuki | |
| 6,852,402 | B2 * | 2/2005 | Kirjavainen | B29C 59/10 307/400 |
| 7,002,070 | B2 | 2/2006 | Katz | |
| 7,005,571 | B1 | 2/2006 | Groff | |
| 7,459,626 | B2 * | 12/2008 | Yoshino | G10H 1/34 84/723 |
| 8,609,973 | B2 | 12/2013 | D'Amours | |
| 8,739,639 | B2 | 6/2014 | Owings et al. | |
| 2002/0152879 | A1 * | 10/2002 | Raisanen | G10H 3/185 84/723 |

(Continued)

FOREIGN PATENT DOCUMENTS

| | | | |
|---|---|---|---|
| JP | 09292880 | A | 11/1997 |
| JP | 10124055 | A | 5/1998 |
| JP | 2001092457 | A | 4/2001 |

OTHER PUBLICATIONS

Instructables, Stickytape Sensors, Internet Posting, Autodesk, Inc. http://www.instructables.com/howto/stickytape+sensors/.

*Primary Examiner* — Marlon Fletcher
(74) *Attorney, Agent, or Firm* — Simpson & Simpson, PLLC

(57) ABSTRACT

A pitch modulating pedal having a base, a first electrode secured to one surface of the base, a first force sensing resistor secured to one surface of the base and positioned atop the first electrode, a flexible housing secured to the base, the flexible housing having a top playing surface and a bottom surface, a second electrode secured to the bottom surface of the flexible housing, a second force sensing resistor secured to the bottom surface of the flexible housing and positioned atop the second electrode, and, an insulating mask operatively arranged between the force sensing resistors, wherein a variable force applied to the top playing surface of the flexible housing causes a corresponding change in the electrical resistance of the first and second force sensing resistors.

8 Claims, 9 Drawing Sheets

(56) References Cited

U.S. PATENT DOCUMENTS

2006/0096448 A1* 5/2006 Yoshino ..... G10H 1/34 84/734
2011/0088536 A1* 4/2011 McMillen ..... G10H 1/348 84/746
2012/0144981 A1* 6/2012 Ciccone ..... G10H 1/344 84/746
2013/0055879 A1* 3/2013 Clark ..... G10H 1/0091 84/737
2014/0238221 A1* 8/2014 Roberts ..... G10H 1/0553 84/724
2014/0290469 A1* 10/2014 Michaud ..... G10H 1/0091 84/741
2015/0000502 A1* 1/2015 Rozendaal ..... G10D 3/06 84/317
2015/0371622 A1* 12/2015 Beaty ..... G10H 1/46 84/633

* cited by examiner

PEDAL FOR MODULATING AN ELECTRONIC SIGNAL

TECHNICAL FIELD

The invention relates generally to pitch modulation devices, more particularly to pitch modulation devices operated by a pedal, and, even more particularly, to a pedal for modulating pitch of an electronic signal, and, still more particularly, to a pedal for modulating pitch of a musical instrument, especially for a keyboard.

BACKGROUND

There is a desire to enable an electronic keyboard to produce pitches between the twelve standard pitches in a controlled manner. Electronic keyboards typically follow the chromatic scale, a musical scale having twelve equally spaced pitches. The twelve pitches are C, C♯D♭, D, D♯/E♭, E, F, F♯/G♭, G, G♯/A♭, A, A♯/B♭, B, with each pitch a semitone above or below another. Normal electronic keyboards are equipped with a pitch wheel. A pitch wheel is a control on a synthesizer that allows the user to vary the pitch in a continuously variable manner. Portamento, or pitch bend, is the musical term that describes pitch sliding from one note to another. Vibrato is the musical term that describes a musical effect consisting of regular, pulsating change of pitch. A pitch wheel works through a mechanical linkage to a rheostat, so as to apply variable resistances to a signal. However, this type of control is inadequate for several reasons. First, it requires the user's left hand to leave the keyboard to use the pitch wheel. Second, the pitch wheel does not impose any variable tactile feedback on the user to reference the amount of bend being applied. Finally, the pitch wheel is too slow in that it does not allow the user to adjust the pitch fast enough, to create vibrato for example. Moreover, existing pedals for electronic instruments are equipped with one or more springs to return the actuator to its original up position after the applied force is removed. However, springs add to the overall height of the device, which increases actuator travel, and often do not support the weight of the user's foot at rest.

It is desirable to be able to provide a pitch modulating pedal having a natural feel. Specifically, the parameters sought to provide such a natural feel are speed, travel, pressure, and sensitivity. With respect to speed, it is essential that the velocity of the effect be controllable, facilitating both slow and fast pitch variation. The best design will be a device that can respond to both the sensitivity and the suddenness of the touch. Travel refers to the movement of the actuator, or the flex member of the device, from the up position to the down position. The movement of the actuator must be small to achieve rapid changes in resistance and equally rapid returns to the base pitch upon release. With respect to pressure, variable tactile feedback from the device is necessary to create the sense of touch by applying forces to the user. Such variable tactile feedback generates a feel for the amount of bend being applied to the pitch. Sensitivity refers to the amount of force the user must apply to obtain a desired change in resistance. The pedal sensitivity contributes to the ability of a user to use light touch to render a slight bend in the pitch. The sensitivity of the pedal is necessary to obtain vibrato and other sound variations between pitches in a controllable manner.

Thus, there has been a long felt need for an improved pedal for modulating an electronic signal. There has also been a long felt need for a pedal for modulating pitch of a musical instrument, especially for a keyboard.

SUMMARY

The present invention broadly comprises a pitch modulating pedal comprising a base plate having a top surface and a bottom surface, a first electrode secured to the top surface of the base plate, a first force sensing resistor secured to the top surface of the base plate and positioned atop the first electrode, wherein the first force sensing resistor has a first surface area, a flexible housing secured to the base plate, the flexible housing having a top playing surface and a bottom surface, a second electrode secured to the bottom surface of the flexible housing, wherein the second electrode has a second surface area, a second force sensing resistor secured to the bottom surface of the flexible housing and positioned atop the second electrode, wherein the second force sensing resistor has a third surface area; and, an insulating mask operatively arranged between the force sensing resistors, wherein the insulating mask has a fourth surface area which is greater than the second surface area and less than either the first surface area or the third surface area, wherein a variable force applied to the top playing surface of the flexible housing causes a corresponding change in the electrical resistance of the first and second force sensing resistors.

The invention also comprises a method of modulating a signal from a musical instrument, comprising the steps of inputting the signal into a pitch modulation circuit, the circuit comprising a first electrode, a first force sensing resistor, a second force sensing resistor, and a second electrode, wherein the first and second force sensing resistors are located within a flexible housing, wherein said flexible housing forms a pedal, and, applying a force to the flexible housing to vary the resistance of each of the first and second force sensing resistors.

A primary object of the invention is to provide a pitch modulation unit that can be controlled by foot that provides tactile feedback to the user to reference the amount of pitch bend being used.

These and other objects, features and advantages of the present invention will become readily apparent upon a review of the following detailed description of the invention, in view of the drawings and appended claims.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention.

Unless defined otherwise, all technical and scientific terms used herein have the same meaning as commonly understood to one of ordinary skill in the art to which this invention pertains. It should be understood that any methods, devices or materials similar or equivalent to those described herein can be used in the practice or testing of the invention. The assembly of the present invention could be driven by hydraulics, electronics, and/or pneumatics.

Figure 1:
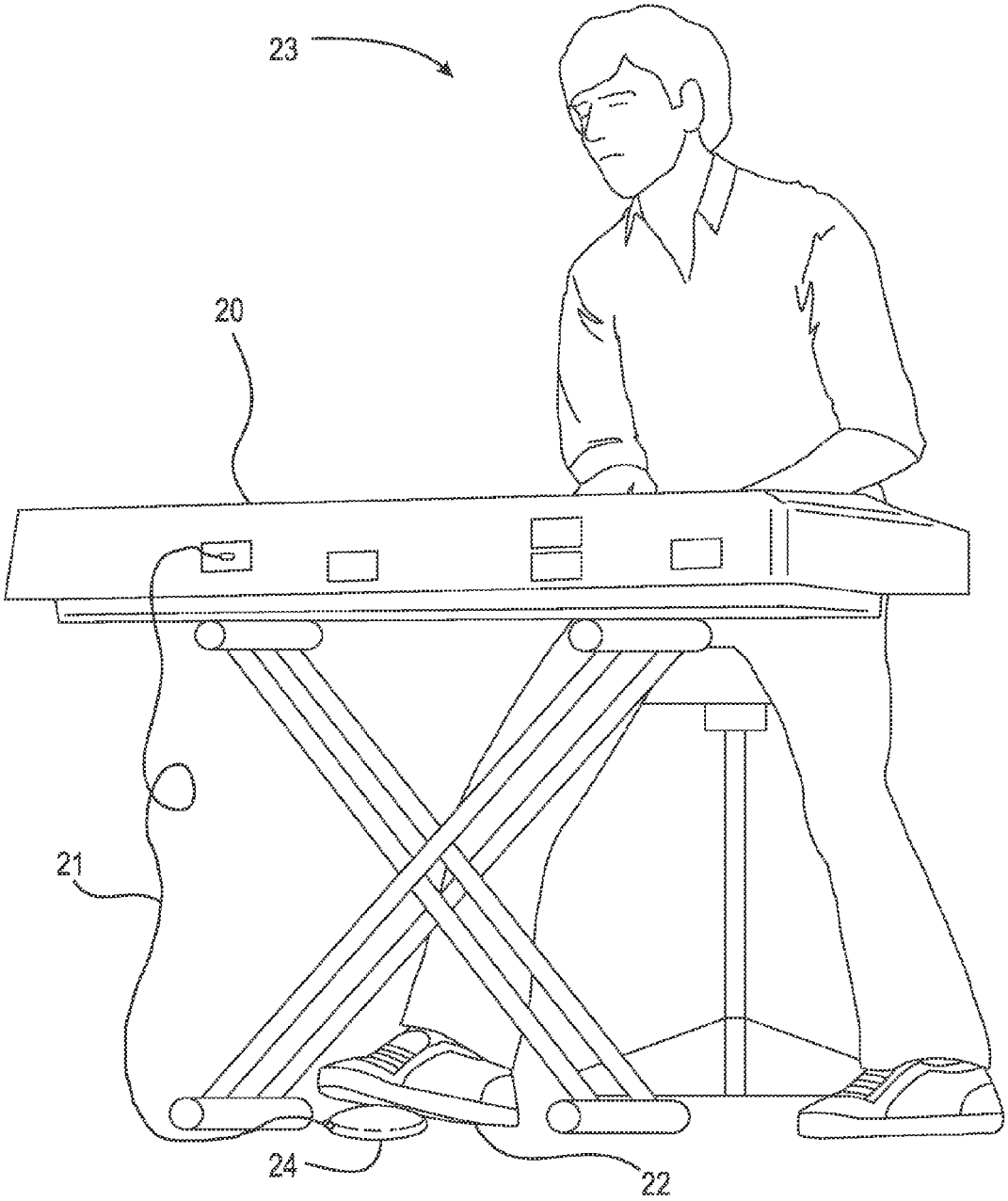
FIG. 1 is a perspective view of an embodiment of the invention in use with an electronic keyboard.

Adverting now to the figures, FIG. 1 is a perspective view of an embodiment of the invention in use with an electronic keyboard. Specifically, instrument cord 21 connects pitch modulating pedal 24 and electronic keyboard 20. User 23 plays electronic keyboard 20 while manipulating pitch modulating pedal 24 with pedal foot 22. It is preferable that user 23 be seated to properly manipulate and utilize the complete functionality of pitch modulating pedal 24. The sitting position allows user 23 to apply force to pitch modulating pedal 24 in a controlled manner and at the appropriate positions thereon. However, user 23 can also manipulate pitch modulating pedal 24 in the standing position.

Figure 2:
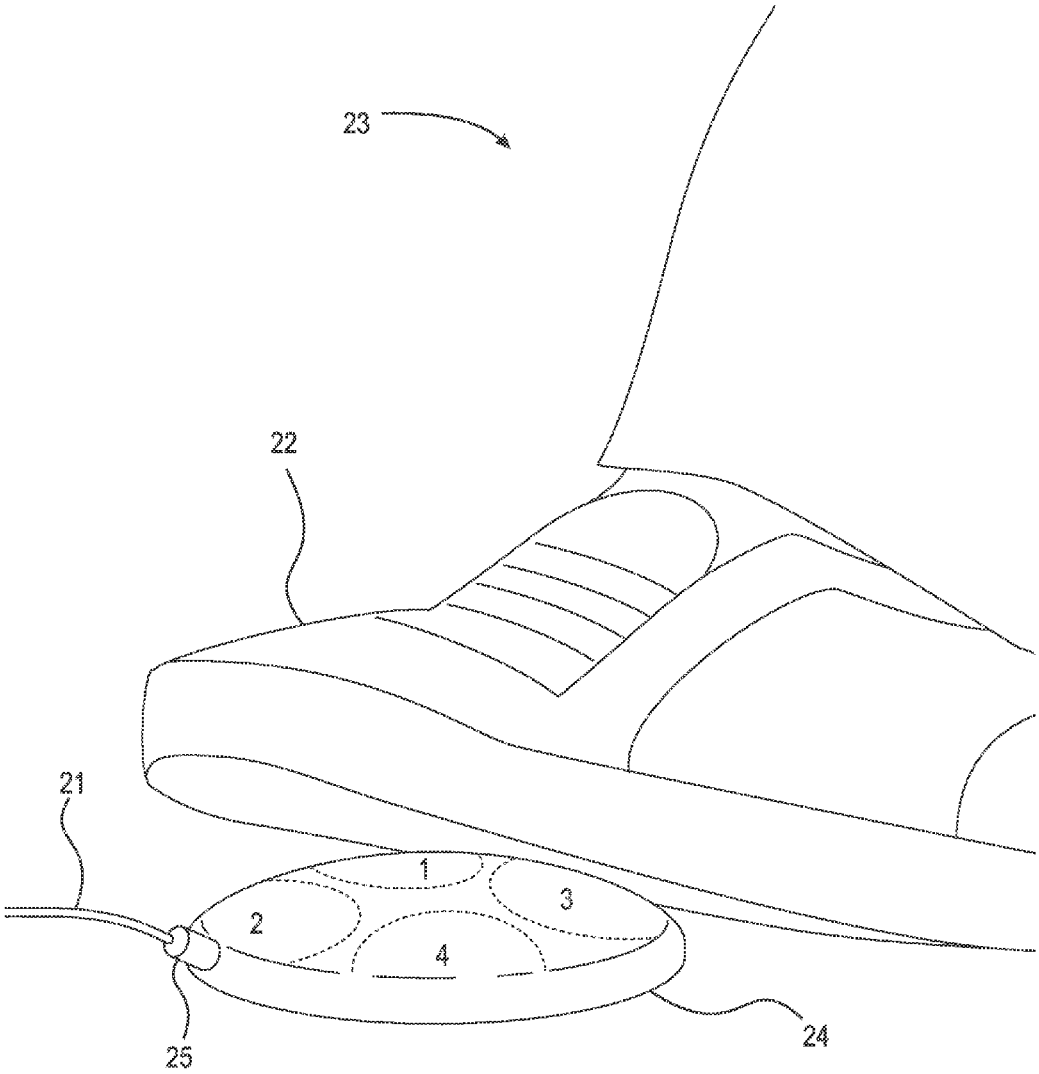
FIG. 2 is a perspective view of an embodiment of the invention in use.

FIG. 2 is a perspective view of an embodiment of pitch modulating pedal 24 in use. In this embodiment, instrument cord 21 is connected to pitch modulating pedal 24 through a ¼ inch (or 6.35 millimeter) two-contact phone connector. The ¼ inch connector is the plug and socket used by the majority of all amplified musical instruments. Almost all electric or electronic instruments, such as guitars, basses, keyboards and drums use a inch mono jack as their output connector. Similarly, the ¼ inch jack is the most common connector for inputs and outputs on instrument amplifiers, microphones, foot switches, effects pedals, and other professional audio equipment. However, it should be appreciated that any type of audio connector used to transmit an analog signal may be used. Also shown in FIG. 2 are four distinct pressure zones located on the top playing surface of flexible housing 26. The pressure zones are labeled 1, 2, 3, and 4 with pressure zone 2 positioned adjacent to telephone connector 25. These pressure zones will be discussed in detail below.

Figure 3A:
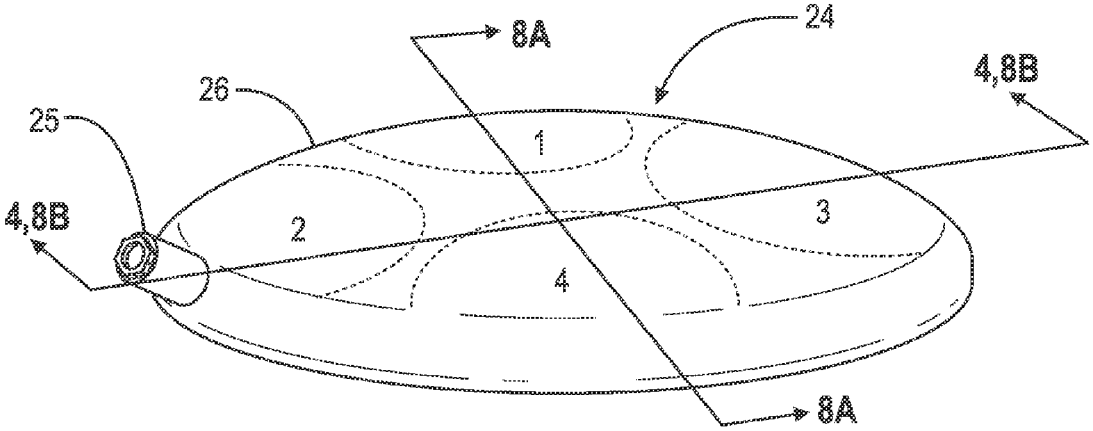
FIG. 3A is a side perspective view of an embodiment the invention.
Figure 3B:
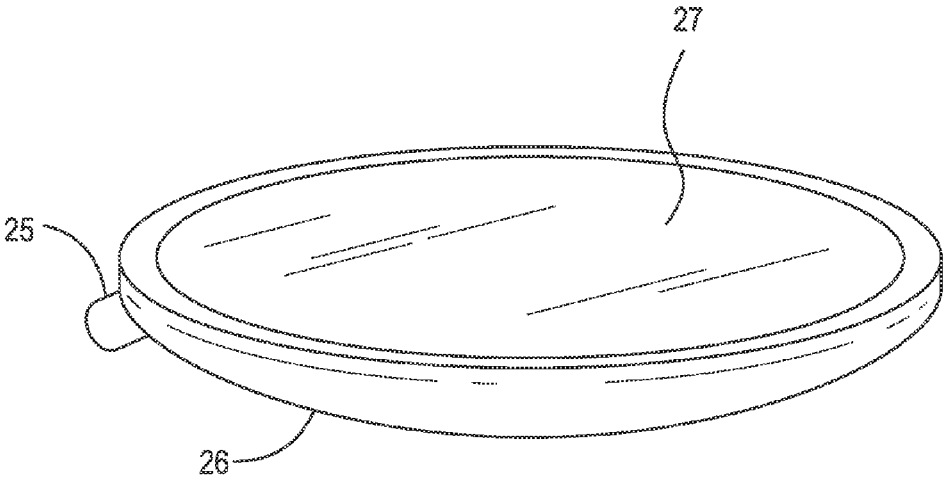
FIG. 3B is a side perspective view of the invention shown in FIG. 3A, except inverted.

FIG. 3A is a side perspective view of an embodiment of pitch modulating pedal 24. FIG. 3B shows a side perspective view of pitch modulating pedal 24 shown in FIG. 3A, except inverted. Specifically, pitch modulating pedal 24 comprises flexible housing 26, base plate 27, and phone connector 25. In a preferred embodiment, flexible housing 26 is made of an elastomer that deforms when force is applied and returns to its original shape when applied force is removed. It should be appreciated that flexible housing 26 can be made of any suitable alternative. Flexible housing 26 is designed to maintain its original shape under the weight of a user's foot at rest, but flex once the user applies force thereto. The term "applied force" is used and hereby defined as the force user 23 applies to flexible housing 26 in addition to the weight of pedal foot 22 in a relaxed state. "Applied force" is necessary to activate pitch modulating pedal 24 and merely placing pedal foot 22 on flexible housing 26 will yield no pitch bend. Thus, when pedal foot 22 is positioned on pitch modulating pedal 24 in a relaxed state applied force equals zero pounds. In addition, after force is applied to pitch modulating pedal 24, flexible housing 26 must offer resilience to achieve quick returns to the base pitch. The base pitch is the standard pitch played on electronic keyboard 20. Additionally, pitch modulating pedal 24 provides user 23 with variable tactile feedback during use. Flexible housing 26 is more resilient near its outer edge than near its center. Thus, flexible housing 26 imposes pressure on user 23 that varies increasingly with radial distance. Base plate 27 is preferably made of a rigid material and is pressed into the bottom of flexible housing 26. It should be appreciated that other securing means, such as adhesives, may be used to secure base plate 27 and flexible housing 26. Phone connector 25 is secured to flexible housing 26. In a preferred embodiment, phone connector 25 is a ¼ inch phone socket secured over a hole in flexible housing 26. Also shown in FIG. 3A are the four pressure zones labeled 1, 2, 3, and 4.

Figure 4:
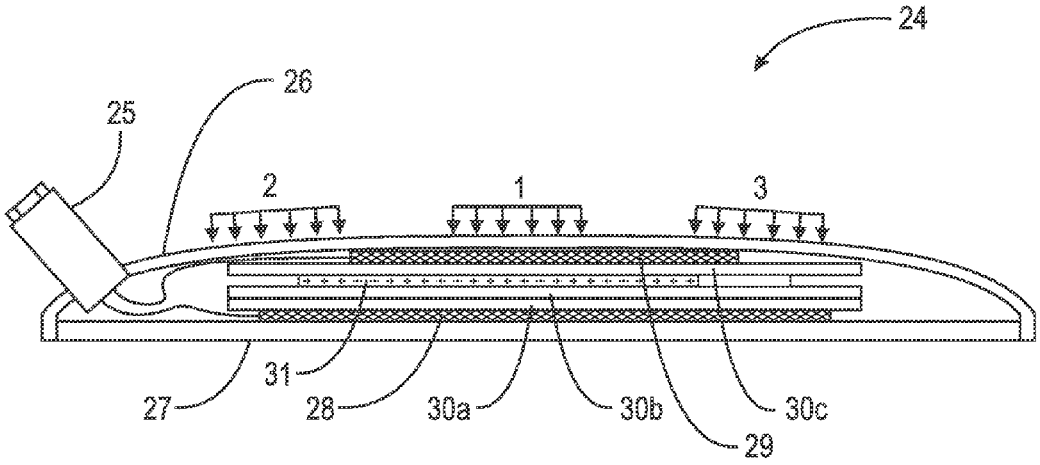
FIG. 4 is a cross-sectional view of an embodiment of the invention taken generally along line 4-4 in FIG. 3A.

FIG. 4 is a cross-sectional view of the invention taken generally along line 4-4 in FIG. 3A. In this embodiment, flexible housing 26 encloses base plate 27, first electrode 28, force sensing resistors 30*a*, 30*b*, and 30*c*, insulating mask 31, and second electrode 29. First electrode 28 and second electrode 29 are electrically connected to the corresponding terminals of phone connector 25. First electrode 28 is the input lead and second electrode 29 is the output lead. In a preferred embodiment, a spray adhesive is used to fix first electrode 28 to the top of base plate 27 and second electrode 29 to the bottom surface of flexible housing 26. It should be appreciated that other methods of adhesion, such as double sided tape, can be used. Also in a preferred embodiment, first electrode 28 and second electrode 29 are shaped in the form of annular discs, although other shapes would be suitable. FIG. 4 also shows the distinct nature of the pressure zones, specifically pressure zones 2 and 3, in greater detail. Force applied to pressure zone 3 bypasses insulating mask 31 resulting in vertical conductivity between first electrode 28, force sensing resistors 30*a*, 30*b*, and 30*c*, and second electrode 29. Insulating mask 31 forces horizontal conductivity through force sensing resistor 30*c* when force is applied to pressure zones 2 and 1. This horizontal conductivity also occurs when force is applied to pressure zone 4, not shown in FIG. 4. The differences between vertical and horizontal conductivity will be discussed in detail below.

In the preferred embodiment, two force sensing resistors 30*a* and 30*b* are stacked on top of first electrode 28 and secured to the top surface of base plate 27. Insulating mask 31 and force sensing resistor 30*c* are stacked on top of second electrode 29 and secured to the bottom surface of flexible housing 26. It should be appreciated that, in the preferred embodiment, three force sensing resistors, 30*a*, 30*b*, and 30*c*, are used to produce the desired sensitivity. Sensitivity refers to the amount of force that must be applied to achieve the full range of resistance levels in pitch modulating pedal 24. However, the amount of force required is in direct proportion to the number of force sensing resistors used. Thus, an increase or decrease in the number of force sensing resistors results in an increase or decrease in the amount of force required to achieve the resistance change. Also, the pitch bend range is set by a parameter in electronic keyboard 20. General Musical Instrument Digital Interface (MIDI), a standardized specification for music synthesizers that respond to MIDI messages, recommends that the total pitch bend range be ±2 semitones, however, the pitch bend range can be adjusted using General MIDI Registered Parameter Number 0, 0.

Figure 6:
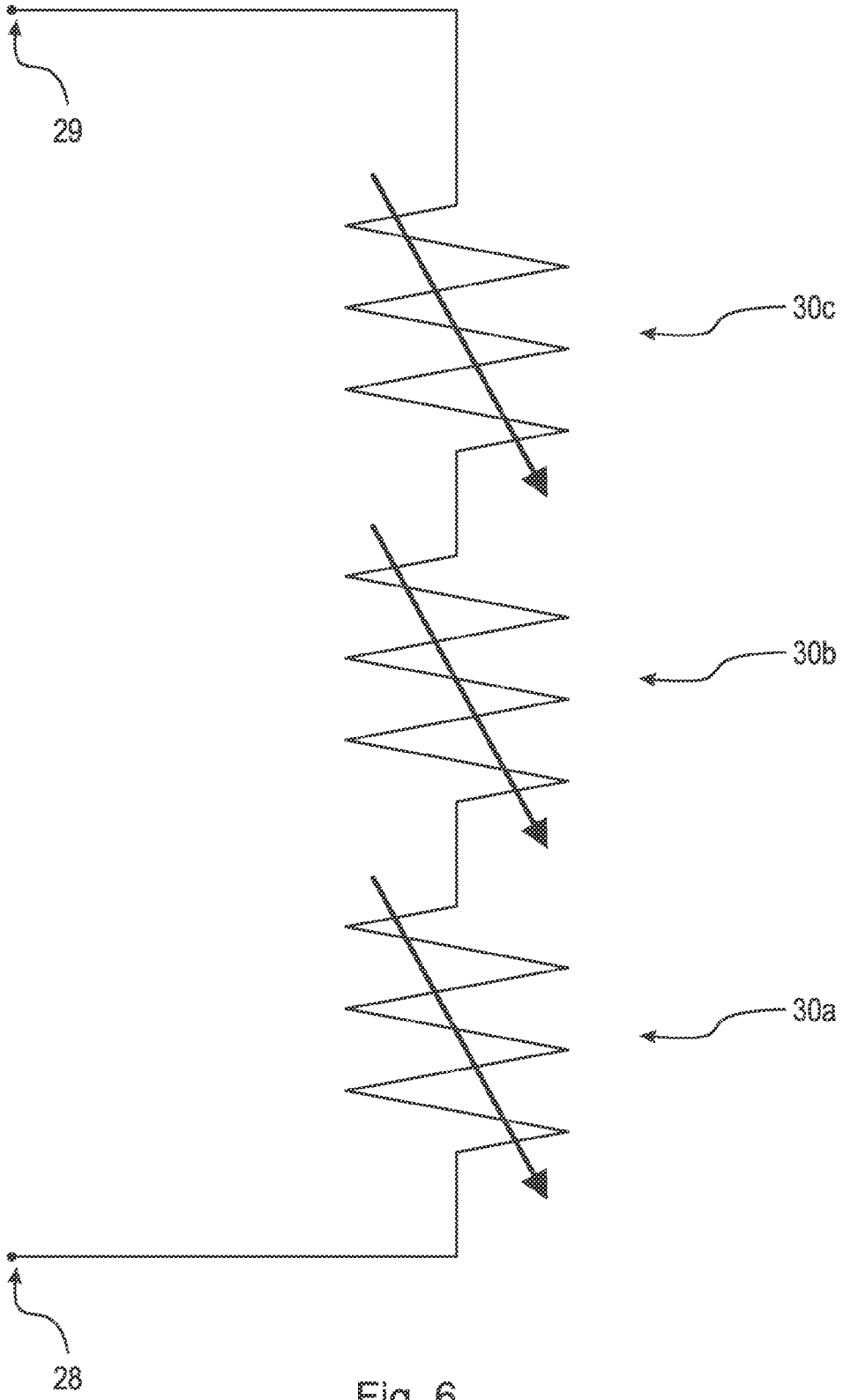
FIG. 6 is a schematic diagram of the electronic circuit of one embodiment of the invention.

Force sensing resistors 30*a*, 30*b*, and 30*c*, as shown in FIG. 6, act as variable resistors. Each force sensing resistor generally has a nominal resistance, which is its resistance value for an applied force of zero pounds. Each force sensing resistor also offers a resistance range having a minimum and maximum resistance value, representing the resistance at maximum and minimum applied force, respectively. These values are generally available from the manufacturer's datasheet, and are essential to the design of an interface circuit for the sensor. In a preferred embodiment, force sensing resistors 30*a*, 30*b*, and 30*c* are made of Velostat™ conductive film. Velostat™ conductive film is made of opaque, volume-conductive, carbon-impregnated polyolefin. The volume resistivity, or inherent resistance, of 4 mil (102 microns) Velostat™ conductive film is 500 ohm-cm (as measured by the test method set forth in ASTM D991). In another embodiment, force sensing resistors 30*a*, 30*b*, and 30*c* are made of Linqstat™ conductive film. Linqstat™ conductive film is a black, carbon-filled, electrically conductive polyethylene plastic film. The volume resistivity, or inherent resistance, of 4 mil (0.1 millimeters) Linqstat™ VCF-Series conductive film is 2,000 ohm-cm (as measured by the test method set forth in MIL-PRF-81705D Type II). Moreover, it should be appreciated that other resistive sensors that act as variable resistors can be used. Examples of other resistive sensors include a carbon pile, graphite powder mixed with clay powder or ground rubber, and carbon fiber discs.

Figure 5:
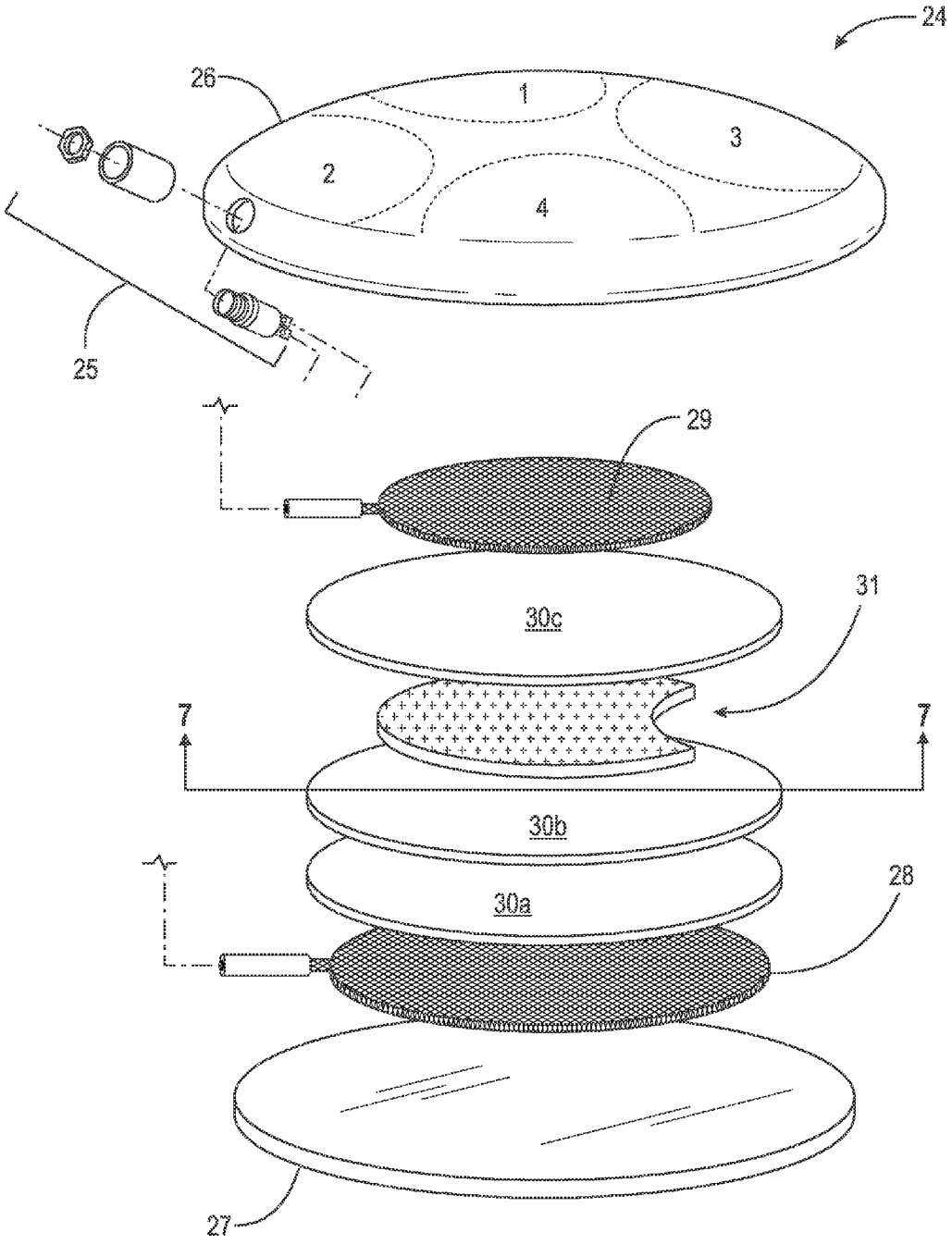
FIG. 5 is an exploded perspective view of the invention shown in FIG. 3A.

FIG. 5 is an exploded perspective view of an embodiment of the invention as shown in FIG. 3A. Insulating mask 31 separates first electrode 28 and force sensing resistors 30*a* and 30*b* from force sensing resistor 30*c* and second electrode 29. In a preferred embodiment, insulating mask 31 has a crescent-like shape. The purpose of the distinct shape of insulating mask 31 is to allow both vertical and horizontal conductivity between force sensing resistors 30*a*, 30*b*, and 30*c*. User 23 can produce different sound variations by choosing to use either vertical or horizontal conductivity, or both. Applying force at pressure zone 3 avoids the limiting effect of insulating mask 31. Force applied at pressure zones 1, 2, and 4 activates the limiting effect of insulating mask 31. The limiting effect of insulating mask 31 is discussed in detail below.

Figure 7:
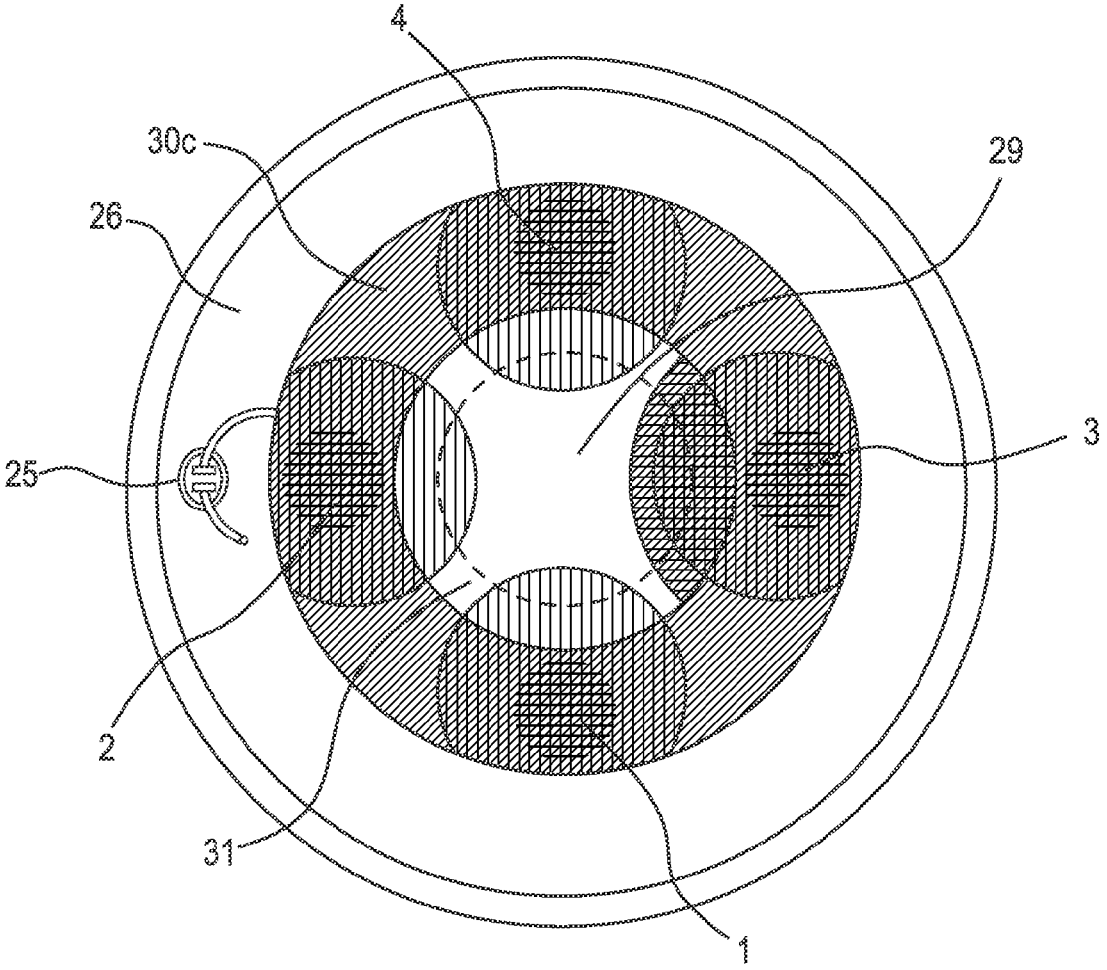
FIG. 7 is a bottom view of the invention taken generally along line 7-7 in FIG. 5.
Figure 8A:
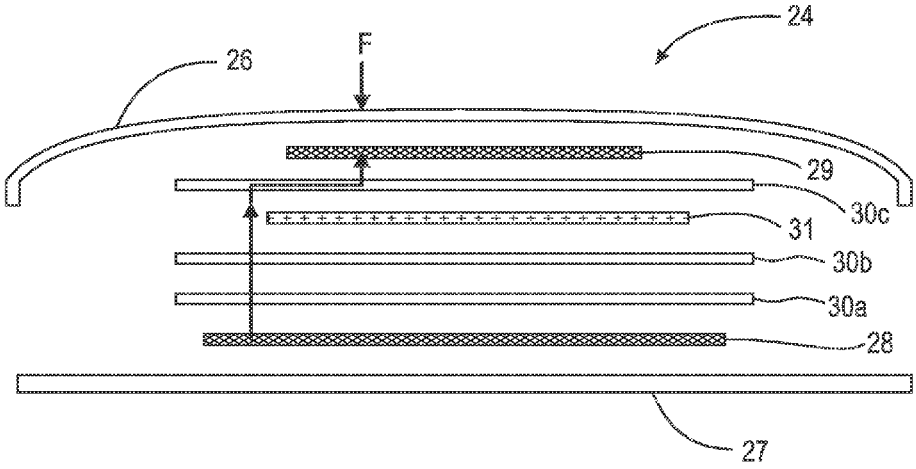
FIG. 8A is a cross-sectional exploded view of an embodiment of the invention taken generally along line 8A-8A in FIG. 3A.
Figure 8B:
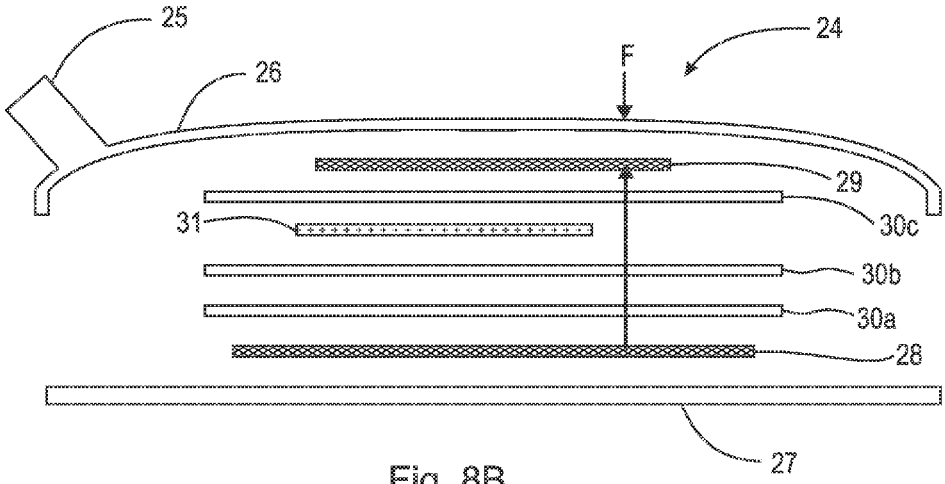
FIG. 8B is a cross-sectional exploded view of an embodiment of the invention taken generally along line 8B-8B in FIG. 3A.

FIG. 7 is a bottom view of pitch modulating pedal 24 taken generally along line 7-7 shown in FIG. 5. FIG. 7 shows insulating mask 31, force sensing resistor 30*c*, second electrode 29, flexible housing 26, and phone connector 25. Also shown in FIG. 7 is a bottom view of pitch modulating pedal 24 showing the four pressure zones 4, 2, 3, and 1 with pressure zone 2 positioned adjacent to telephone connector 25. When user 23 applies a force F to pitch modulating pedal 24 at pressure zones 4, 2, or 1 insulating mask 31 prevents vertical conductivity between force sensing resistor 30*c* and second electrode 29. Instead, as shown in FIG. 8A, conductivity is routed vertically from first electrode 28 through force sensing resistors 30*a*, 30*b*, and 30*c*, then horizontally through force sensing resistor 30*c*, and then vertically to second electrode 29. This path of horizontal conductivity through force sensing resistor 30*c* prevents total resistance from approaching zero ohms. The effect of this restraint on total resistance reduction is to limit the amount of pitch bend user 23 can produce with applied force F. Therefore, in the preferred embodiment, applying force F at pressure zones 4, 2, or 1 limits the maximum pitch bend to less than two semitones. Also, in another embodiment pressure zone 2 is used as a wiring and attachment cavity. Conversely, as shown in FIG. 8B, when user 23 applies force F to pitch modulating pedal 24 at pressure zone 3 insulating mask 31 does not inhibit conductivity. Instead, insulating mask 31 is bypassed through its crescent-shaped notch and vertical conductivity between force sensing resistor 30*c* and second electrode 29 is achieved. This path of vertical conductivity allows the total resistance of force sensing resistors 30*a*, 30*b*, and 30*c* to diminish to zero ohms. The effect of applying force F at pressure zone 3 and enabling vertical conductivity is to allow user 23 to produce the maximum pitch bend. In the preferred embodiment the maximum pitch bend is equal to two semitones, but as described above, the amount of pitch bend can be modified by varying the pitch bend range parameter in electronic keyboard 20.

FIG. 8A is a cross-sectional exploded view of an embodiment of the invention taken generally along line 8A-8A in FIG. 3A. Force F is applied at pressure zone 1, however it should be appreciated that applying force F at pressure zones 2 and 4 will achieve the same effect. Insulating mask 31 prevents pure vertical conductivity causing horizontal conductivity through force sensing resistor 30*c*. The effect of horizontal conductivity through force sensing resistor 30*c* prevents the total resistance reduction from approaching zero ohms. Thus, applying force F at pressure zones 1, 2, or 4 limits the pitch bend to less than the maximum allowable pitch bend, as previously set by the pitch bend range parameter in electronic keyboard 20. It should be appreciated that this lower limit may be modified by varying the pitch bend range parameter in electronic keyboard 20.

FIG. 8B is a cross-sectional exploded view of an embodiment of the invention taken generally along line 8B-8B in FIG. 3A. Force F is applied at pressure zone 3. At pressure zone 3, insulating mask 31 does not limit conductivity and pure vertical conductivity can be obtained. Pure vertical conductivity through force sensing resistors 30*a*, 30*b*, and 30*c* allows user 23 to decrease the total resistance to zero ohms with applied force F. Therefore, in the preferred embodiment, a maximum pitch bend of two semitones can be obtained by applying force F at pressure zone 3. It should be appreciated that the maximum pitch bend may be modified by varying the pitch bend range parameter in electronic keyboard 20.

Figure 9A:
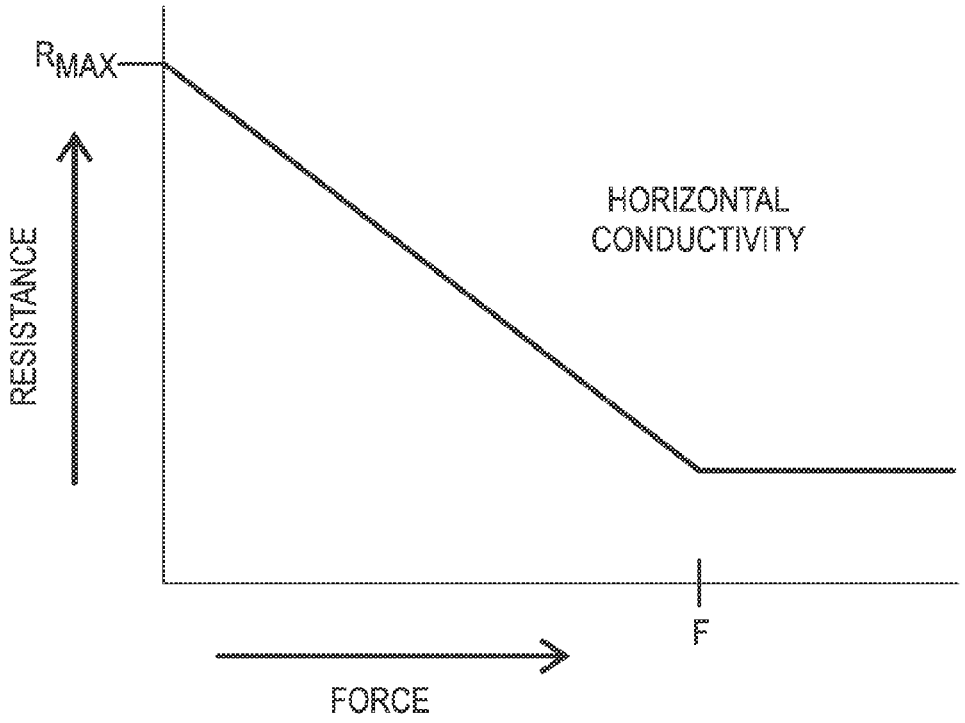
FIG. 9A is a diagram illustrating the relationship between applied force and resistance for horizontal conductivity demonstrated in FIG. 8A; and, FIG. 9B is a diagram illustrating the relationship between applied force and resistance for vertical conductivity demonstrated in FIG. 8B.
Figure 9B:
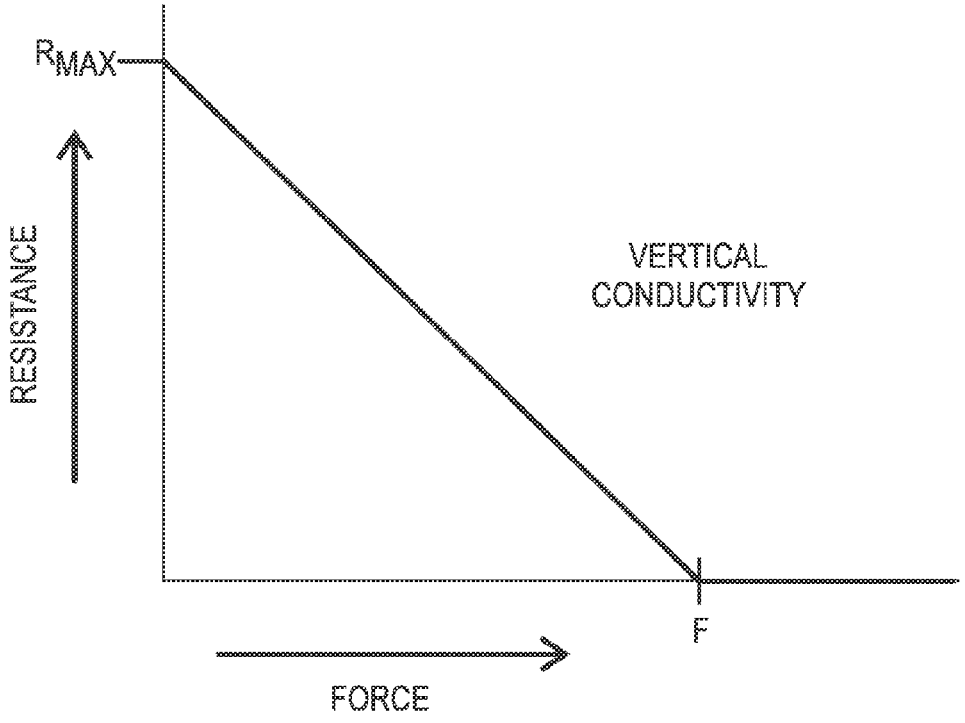

FIG. 9A is a diagram illustrating the relationship between applied force and resistance for horizontal conductivity as demonstrated in FIG. 8A. FIG. 9B is a diagram illustrating the relationship between applied force and resistance for vertical conductivity as demonstrated in FIG. 8B. It should be appreciated that maximum total resistance, $R_{MAX}$, occurs when applied force equals zero pounds. Force F represents the minimum applied force at which the minimum total resistance can be obtained. FIG. 9A illustrates the limiting effect on the total resistance reduction when insulating mask 31 forces horizontal conductivity through force sensing resistor 30*c*. As previously stated, horizontal conductivity occurs when force is applied at pressure zones 1, 2, or 4. Notice that applied force greater than or equal to F produces the lowest total resistance. This is also true for vertical conductivity seen in FIG. 9B, but an applied force greater than or equal to F produces a total resistance of zero ohms. FIG. 9B illustrates vertical conductivity, which can be obtained when force is applied at pressure zone 3 and insulating mask 31 is bypassed. Thus, applying force F at pressure zone 3 results in the maximum pitch bend, as previously set in electronic keyboard 20.

It will be appreciated that various aspects of the above-disclosed invention and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

20 electronic keyboard
21 instrument cord
22 pedal foot
23 user
24 pitch modulating pedal
25 phone connector
26 flexible housing
27 base plate
28 first electrode
29 second electrode
30*a* force sensing resistor
30*b* force sensing resistor
30*c* force sensing resistor
31 insulating mask

What is claimed is:

1. A pitch modulating pedal, comprising:

a base plate having a top surface and a bottom surface;

a first electrode secured to said top surface of said base plate;

a first force sensing resistor secured to said top surface of said base plate and positioned atop said first electrode, wherein said first force sensing resistor has a first surface area;

a flexible housing secured to said base plate, said flexible housing having a top playing surface and a bottom surface;

a second electrode secured to said bottom surface of said flexible housing, wherein said second electrode has a second surface area;

a second force sensing resistor secured to said bottom surface of said flexible housing and positioned atop said second electrode, wherein said second force sensing resistor has a third surface area; and, an insulating mask operatively arranged between said force sensing resistors, wherein said insulating mask has a fourth surface area which is greater than said second surface area and less than either said first surface area or said third surface area, wherein a variable force applied to said top playing surface of said flexible housing causes a corresponding change in the electrical resistance of the first and second force sensing resistors.

2. The pitch modulating pedal as recited in claim 1 wherein each of said first and second force sensing resistors comprises an electrically conductive polymeric foil layer impregnated with carbon black, wherein the resistance of said force sensing resistor varies with a force applied to each said resistor.

3. The pitch modulating pedal as recited in claim 1, wherein the first electrode, the first force sensing resistor, the second force sensing resistor, and the second electrode form a series electric circuit.

4. The pitch modulating pedal as recited in claim 3, wherein the resistance of each of the force sensing resistors decreases as force is applied to the resistors.

5. The pitch modulating pedal as recited in claim 4, wherein an electronic signal passed through said circuit is modified by varying the resistance of each of the force sensing resistors by application of said force.

6. The pitch modulating pedal as recited in claim 4, wherein said insulating mask limits the total resistance reduction of said force sensing resistors.

7. The pitch modulating pedal as recited in claim 6, wherein said insulating mask defines said top playing surface of said flexible housing into at least 1 zone, wherein each of said zones embodies independent resistive properties, such that a force applied to any of said zones causes the electrical resistance of the first and second force sensing resistors to decrease at a rate independent of each of said zones.

8. The pitch modulating pedal as recited in claim 1, wherein said flexible housing encloses said electrodes, force sensing resistors, and insulating mask.

* * * * *